US008288712B2

(12) United States Patent
Bouyer et al.

(10) Patent No.: US 8,288,712 B2
(45) Date of Patent: Oct. 16, 2012

(54) GUIDED COHERENT ATOM SOURCE AND ATOMIC INTERFEROMETER

(75) Inventors: Philippe Bouyer, Bures sur Yvette (FR); Vincent Josse, Paris (FR); William Guerin, Verneuil sur Seine (FR); Juliette Billy, Gif sur Yvette (FR); Arnaud Landragin, Orsay (FR)

(73) Assignees: Ixsea, Marly-le-Roi (FR); Institut d'Optique Graduate School, Palaiseau (FR); Observatoire de Paris, Paris (FR)

( * ) Notice: Subject to any disclaimer, the term of this patent is extended or adjusted under 35 U.S.C. 154(b) by 502 days.

(21) Appl. No.: 12/406,276

(22) Filed: Mar. 18, 2009

(65) Prior Publication Data

US 2009/0242743 A1 Oct. 1, 2009

(30) Foreign Application Priority Data

Mar. 19, 2008 (EP) ..... 08305062

(51) Int. Cl.
*H05H 3/02* (2006.01)

(52) U.S. Cl. ..... 250/251; 356/450; 356/459; 356/460

(58) Field of Classification Search ..... 250/251; 356/450, 459, 460
See application file for complete search history.

(56) References Cited

U.S. PATENT DOCUMENTS

| | | | | |
|---|---|---|---|---|
| 5,274,232 | A * | 12/1993 | Chu et al. | 250/251 |
| 6,476,383 | B1 * | 11/2002 | Esslinger et al. | 250/251 |
| 6,548,809 | B2 * | 4/2003 | Bouyer et al. | 250/251 |
| 7,030,370 | B1 * | 4/2006 | Crookston et al. | 250/251 |
| 7,126,112 | B2 | 10/2006 | Anderson et al. | |
| 2001/0042824 | A1 | 11/2001 | Bouyer et al. | |
| 2005/0199871 | A1 * | 9/2005 | Anderson et al. | 257/14 |
| 2007/0158541 | A1 * | 7/2007 | Katori | 250/281 |
| 2010/0012827 | A1 * | 1/2010 | Vestergaard | 250/251 |
| 2010/0147071 | A1 * | 6/2010 | Schwartz et al. | 73/382 R |
| 2010/0200739 | A1 * | 8/2010 | Anderson et al. | 250/251 |
| 2010/0320995 | A1 * | 12/2010 | David et al. | 324/72 |

FOREIGN PATENT DOCUMENTS

EP 1130949 9/2001

OTHER PUBLICATIONS

Folman, R., et al, "Controlling Cold Atoms Using Nanofabricated Surfaces: Atom Chips", Physical Review Letters APS, May 15, 2000, pp. 4749-4752, vol. 84, No. 20, XP002493511.

(Continued)

*Primary Examiner* — Michael Logie
(74) *Attorney, Agent, or Firm* — Young & Thompson

(57) ABSTRACT

A guided coherent atom source (1) includes elements for generating neutral atoms in a gaseous state (2), elements for cooling the atoms gas (3), elements for generating a magnetic field (4), including an electro-magnetic micro-chip (6) deposited on a surface (18) of a substrate (14), and capable of condensing the atoms in a magnetic trap, elements for generating an electro-magnetic RF field capable of extracting the condensed atoms, optical elements (10) for emitting and directing an optical coherent beam (12) toward the condensed atoms able to guide the condensed atoms, characterized in that the optical elements (10) and the electro-magnetic micro-chip (6) are integrated onto the same substrate (14). An atomic interferometer using such a source is also disclosed.

27 Claims, 5 Drawing Sheets

OTHER PUBLICATIONS

Diot, D., et al, "Optical Beam Splitter Integrated on a Magnetic Atom Chip", International Quantum Electronics Conference, 2004, pp. 1, XP002493509.

Wilzbach, M., et al, "Integration of Light and Atom Optics on an Atom Chip", AIP Conference Proceedings, 2004, pp. 443, XP002493510.

Birkl, G., et al, "Atom Optics with Microfabricated Optical Elements", Optics Communications, May 1, 2001, pp. 67-81, vol. 191, No. 1-2, Elsevier NE, XP002493512.

Bartenstein, M., et al., "Atoms and Wires: Toward Atom Chips", IEEE Journal of Quantum Electronics, Dec. 2000, pp. 1364-1377, vol. 36, No. 12, XP002493513.

Guerin, W., et al., "Guided Quasicontinuous Atom Laser", Physical Review Letters, Nov. 13, 2006, pp. 200402-1-200402-4.

European Search Report dated Aug. 27, 2008 from corresponding EP 08305062.5.

* cited by examiner

GUIDED COHERENT ATOM SOURCE AND ATOMIC INTERFEROMETER

The present invention concerns a guided coherent atom source or matter-wave laser. The invention also concerns an atomic interferometer which can be used for inertial atom sensors.

Methods and apparatus have been developed for manipulating atoms. U.S. Pat. No. 5,274,232 describes an "atomic fountain" wherein the atoms are initially trapped in a magnetic trap and then launched vertically with a controlled velocity.

The general principle of magnetic trapping for cold atoms is known. Devices including permanent magnets have been used to produce high density Bose-Einstein Condensate (BEC). However, such devices do not allow to cancel the magnetic field, so they do not enable to extract atoms from the condensate.

Electromagnetic devices that produce magnetic trapping of cold neutral atoms have also been developed. For example, EP 1130949 describes a ferromagnetic structure with six-poles used to generate a trapping magnetic field. This setup allows continuous or pulsed operation with turn-off times of 100 ms. The electro-magnetic structure enables to adjust the magnetic fields produced by the various coils by adjusting the current flowing through the coils. Such an electro-magnetic device allows to generate high density cold neutral atoms condensate.

Hybrid magneto-optic trapping of cold neutral atoms has also been described (Guérin et al., Phys. Rev. Lett., 97, 200402 (2006), noted [PRL 97] below) by superimposing an optical laser beam (from a Nd:YAG laser, $\lambda$=1064 nm) to a magnetically trapped cold cloud of $^{87}$Rb atoms. Bose-Einstein Condensation is directly obtained at the intersection of the magnetic trap with an elongated optical trap.

After trapping, atoms can be released and dropped or launched in order to create a guided atom source. For use in atom interferometry, the atoms direction, velocity, and repetition rate must be extremely controlled.

The general principle of a coherent guided atom source, or "guided atom laser" in short, is also known. The publication [PRL97] reports the realization of a guided quasicontiuous atom laser, where the coherent source, i.e. the trapped BEC, and an optical waveguide are merged together in a hybrid configuration of a magnetic Ioffe-Pritchard trap and a horizontally elongated far off-resonance optical trap, constituting an atomic waveguide. The BEC, in a state sensitive to both trapping potentials (magnetic and optic), is submitted to an RF-outcoupler yielding atoms in a state sensitive only to the optical potential. The atoms are submitted to a repulsive potential due to interactions with the BEC that give a first kinetic energy to the atom beam. A coherent matter-wave is thus extracted, and the atoms propagate along the weak confining direction of the optical tweezer, resulting in an atom laser. This guided $^{87}$Rb atom laser presents a large and almost constant de Broglie wavelength $\geqq$0.5 μm., with the atom-laser velocity ~9 mm·s$^{-1}$ and an atom flux of $5\times10^5$ at·s$^{-1}$.

The advantage of such an atom laser is to provide a coherent beam of atoms extracted from a magnetic trap, wherein the atoms position and direction are well defined in space due to the optical waveguide. The guided atom coherent source also enables to adjust the atoms velocity, i.e. the atom laser wavelength, by adjusting the laser focus and RF power. The atom laser thus formed is equivalent to an optical laser source pigtailed to a fiber optic, wherein photons propagate along the fiber optic waveguide.

High precision inertial atom sensors in embedded systems are desirable for land or underwater navigation and geodesy. Another field of application is the use of inertial atom sensors in microgravity or in space for fundamental physics experiments or for inertial mapping.

Embedded inertial atom sensors would be improved with a compact, portable guided coherent atom source able to produce cold atoms with precise position, emission direction, velocity, high repetition rate, and high brilliance (flux×collimation) that was not available prior to the invention.

As a matter of fact, the setup disclosed in [PRL 97] cannot be used to make a compact and portable inertial sensor for various environments (navigation, space . . . ) because it uses electro-magnetic (ferromagnetic structure) and optical components (Nd:YAG laser) that are too bulky and energy-consuming to be embedded. The magnetic structure power consumption is around a few hundred Watts. The Nd:YAG laser output is around 2 W.

Besides, the setup disclosed in [PRL 97] does not allow high rate repeatability, due to experimental imperfections. The setup long term stability is limited by centering inaccuracy between the magnetic trap and optical waveguide. For high precision atomic interferometry applications, the atomic source must be positioned with ~1 μm precision.

Prior art atomic fountains propose setups where atoms fall under gravity or are launched but with large position and direction uncertainty. The difficulty for high precision atomic interferometry lies not only in atoms trapping, but also in injecting into a waveguide and guiding them while maintaining coherency.

In order to miniaturize components for atom sources, integrated magnetic traps have been disclosed (for example see U.S. Pat. No. 7,126,112). Such magnetic traps use electric wires deposited on a substrate that generate magnetic fields. U.S. Pat. No. 7,126,112 reports the integration of a microchip in a sealed vacuum chamber used to confine, cool and manipulate cold atoms. The atom-chip is used to create an electro-magnetic field and produce a $^{87}$Rb BEC.

As outlined in U.S. Pat. No. 7,126,112 (Col 6 L 5-7), chip-scale atomic system require an unwieldy assembly of electronic, optical and vacuum instrumentation. U.S. Pat. No. 7,126,112 simplifies the vacuum system for BEC atom chip, by sealing the atom chip into the wall of a vacuum chamber. This vacuum chamber includes optical access for external light beams coming from UV lamps. A silver mirror can be transferred to the chip surface to create a MOT. However, such an optical beam is not sufficient for confining and guiding atoms. The device disclosed in U.S. Pat. No. 7,126,112 does not show how to couple and align the magnetic trap and the optical beam, and it does not form an atom laser. This device does not allow efficient atoms extraction for interferometry. Even if the system disclosed in U.S. Pat. No. 7,126,112 is more compact than previous system using solid ferromagnetic structures, it is still too bulky for embedded sensors. In addition, it does not solve the difficulty in alignment between the magnetic trap and the optical waveguide.

It is an object of the invention to propose a compact, lightweight, low energy-consuming coherent guided atom source, that provides cold atoms having precision controlled and adjustable position, direction and velocity at a high repeatability rate.

The guided coherent atom source according to the invention solves these difficulties by integrating onto a same substrate an electro-magnetic micro-chip and a solid-state laser source.

Concerning the application to cold-atom interferometry, prior art coherent atom sources provide insufficient measurement repetition rate. In addition, high gradient magnetic fields from bulk ferromagnetic trap structures induce perturbations that prevent high precision measurements.

The atom source of the invention is compact enough so that coherent atoms can be used away from the magnetic trap, without being perturbed by residual magnetic fields. The atom source of the invention provides high repetition rate atom laser production thus allowing high precision interferometry measurements.

The invention concerns a guided coherent atom source comprising means for generating neutral atoms in a gaseous state;

means for cooling the atoms gas;

means for generating a magnetic field, comprising an electro-magnetic micro-chip deposited on a surface of a substrate, and capable of condensing the atoms in a magnetic trap;

means for generating an electro-magnetic RF field capable of extracting the condensed atoms;

optical means for emitting and directing an optical coherent beam toward the condensed atoms able to guide the condensed atoms, characterized in that the optical means and the electro-magnetic micro-chip are integrated onto the same substrate.

In various embodiments the invention also concerns the following features, that can be considered alone or according to all possible technical combinations and each bring specific advantages:

the electro-magnetic micro-chip and the optical means are located one relatively to the other to ensure built-in intersection of the magnetic trap and of the optical waveguide, the axis of the optical coherent beam is centered onto the magnetic trap for condensed atoms, the emission axis of the optical coherent beam is transverse with respect to the substrate surface bearing the electro-magnetic micro-chip, the emission axis of the optical coherent beam is parallel to the substrate surface bearing the electro-magnetic micro-chip, the optical means comprise a diode laser, the optical means comprise a vertical cavity surface emitting laser (or VCSEL), the optical means include a microlens for directing the optical coherent beam, the substrate surface comprises an optical coating that is able to reflect at the trapping wavelength for <<hot >> atoms and that is transparent at the wavelength of the optical coherent beam, the atoms are chosen among the alkaline or alkaline earths or rare earths atoms, the atoms are $^{87}$Rb atoms, the means for generating a magnetic field comprise means for generating a permanent magnetic field, the means for generating a permanent magnetic field comprise a magnetic layer integrated into the substrate, the electro-magnetic micro-chip comprises electrically conductive wires in a shape chosen from Z-shape, U-shape, double Z-shape, and/or concentric circles, the electro-magnetic micro-chip comprises multilayer electrically conductive wires.

The invention also concerns an atomic interferometer comprising at least one coherent guided atom source as recited above, and means for generating optical beams capable of creating Bragg or Raman-type wavepacket manipulation of the atoms from the said guided coherent atom source.

The above description is given as an example of the invention but can have various embodiments that will be better understood when referring to the following figures:

FIG. 1 is a schematic representation of a guided coherent atom source according to the present invention.

Figure 1:
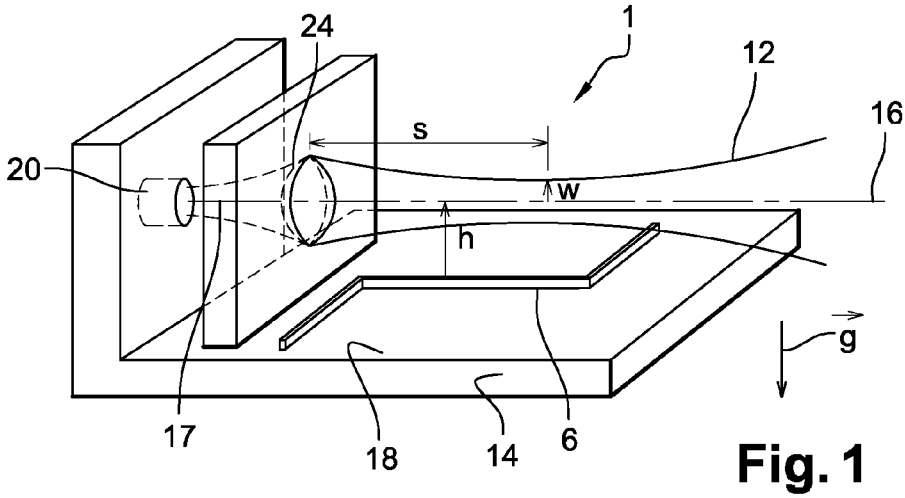
FIG. 1 represents a first embodiment of a guided coherent atom source according to the invention using a diode laser.

This guided coherent atom source 1 comprises means for generating neutral atoms in a gaseous state (not shown in FIG. 1) and means for cooling the atoms gas (not shown).

The atoms belong to the alkaline or alkaline earths atoms. In the example below $^{87}$Rb atoms are used for the atom source of the invention. Other convenient atoms (such as Ytterbium) could also be used.

The atom source 1 comprises means for generating a magnetic field 4, and more particularly an electro-magnetic micro-chip 6 capable of condensing the atoms in a BEC. The magnetic trap is obtained using wires on an micro-chip, providing a magnetic field pattern similar (considering gradients, intensity and field geometry) to the one obtained using a bulky ferromagnetic structure, but with reduced size. The electrically conductive wires 6 are patterned on a surface 18 of the substrate 14. Different wires patterns can be used.

Figure 2A:
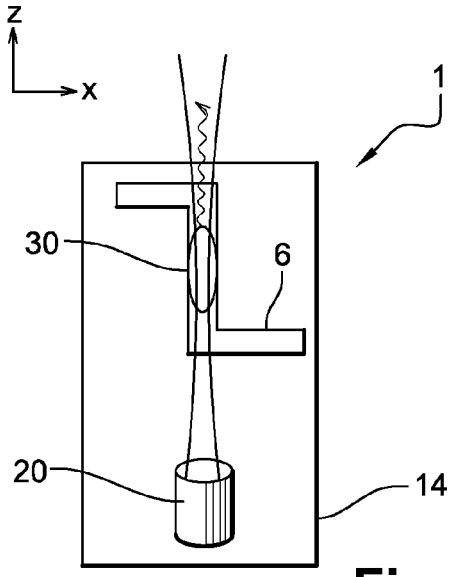
FIG. 2A represents in top view and FIG. 2B in side view the same embodiment of atom laser represented in FIG. 1.
Figure 2B:
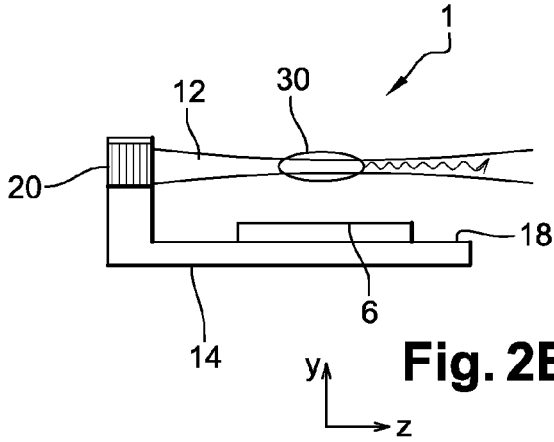
Figure 3A:
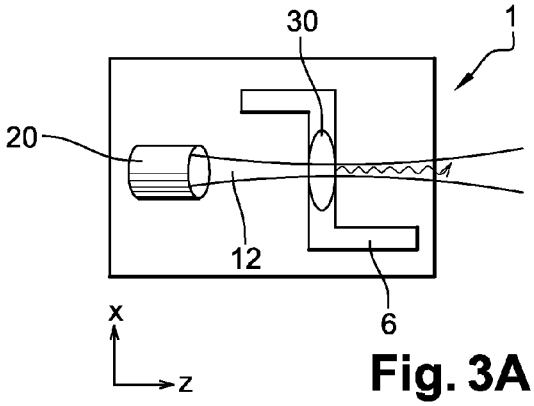
FIG. 3A represents in top view and FIG. 3B in side view another embodiment of an atom laser according to the invention using a diode laser and a Z-shape electro-magnetic circuit, where the diode laser axis is transverse with respect to the main Z branch.
Figure 3B:
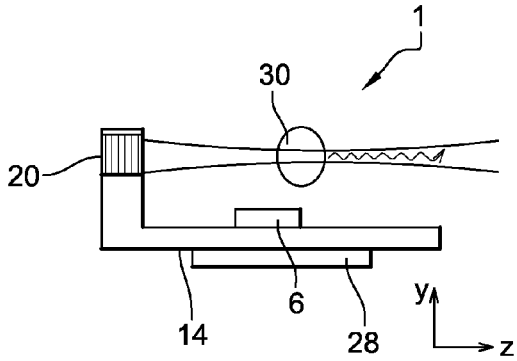

In a first embodiment shown in FIGS. 1-3, the wire 6 has a Z-shape. The ends of the conducting wire are connected to external plugs for applying an electric current from an electric power supply (not represented). When an electric current is applied to the Z-shaped wire 6, a magnetic field is induced around the wire. When combined with a homogeneous $B_0$ magnetic field, in a direction perpendicular to the central wire, the resulting magnetic field produces provides an elongated anisotropic magnetic trap along the central branch of the Z at a distance h from the substrate surface. A bias $B_Z$ magnetic field is superimposed. This structure, when supplied with required current, forms an electro-magnetic micro-chip, able to trap atoms above the Z wire center line, at a mean distance from the substrate surface given by the equation:

$$h=\mu_0 I/(2\pi B_0)$$

The radial confinement gradient is given by the equation $$b'=B_0/h=2\pi B_0^2/(\mu_0 I)$$

The confinement is thus stronger when electric current is small, and when the atoms cloud is close to the surface. So a process for producing the desired condensed atoms consists in creating the BEC in a magnetic trap confined close to the substrate surface, and then to control the condensed atoms position relatively to the surface by changing the current. In this way, the confinement is reduced as required to form a guided atom source (see [PRL 97]).

Typical parameters can be as follow:

$B_0$=6 G; $B_z$=1 G; I=100 mA (high confinement): h=33 μm, ω=2π*1.6 kHz $B_0$=6 G; Bz=1 G; I=3 A (low confinement): h=1 mm, ω=2π*54 Hz The condensed atoms form a Bose-Einstein Condensate (BEC). The distance between the BEC 30 and the substrate surface 18 can be adjusted by varying the applied electric current. More particularly, the BEC 30 is first formed in the vicinity of the substrate surface 18, and the electric current is progressively increased in order to increase the distance between the substrate 14 and the BEC 30 and to decrease the BEC radial confinement.

The atom source 1 of FIGS. 1-3 comprises means for generating an electro-magnetic RF field 8 (not represented) capable of extracting the condensed atoms. By applying a low amplitude (mW, V) RF-field (frequency equals $\mu_0 B$) near the boundary of the BEC the atoms become insensitive to the magnetic trapping potential and the atoms can propagate outside the magnetic trap. The means for generating an electro-magnetic RF field 8 can be the wires 6, or additional wires, or an external antenna, or an integrated antenna formed on the same substrate 14.

The atom source 1 comprises a laser diode 20 for emitting and directing an optical coherent beam 12 toward the condensed atoms so that the condensed atoms acquire a velocity and are guided by the said optical coherent beam (12). The laser diode emission wavelength is selected to be off resonance for atoms internal transition. $^{87}$Rb has transitions at ~780 nm. and 795 nm., so the laser wavelength is chosen above 780 nm. A diode laser emitting around ~1.064 μm can be used, with an output power of a few hundred mW. The difference between resonance and guiding laser wavelength is noted Δ. The optical guiding force is proportional the laser intensity, and inversely to the laser waist dimention (w) and to Δ:

$$F=k\cdot I/(w\cdot\Delta)$$

By varying the electric power supplied to the laser diode, the optical beam intensity can be adjusted. This enables to adjust a guiding force, and thus to adjust the atoms acceleration between 0 and 10 mm·s$^{-2}$. After applying an RF-EM field, the atoms are still sensitive to the optical potential and thus propagate along the optical beam axis. The atoms are attracted toward the high intensity region and thus guided along the optical waveguide. The atoms propagate in one direction or in two opposed directions depending on adjustment of waist position relatively to the atoms.

As shown in FIG. 1 the optical means 20 and the electro-magnetic micro-chip 6 are integrated onto a same substrate 14.

As shown in FIGS. 1-3, the laser diode 20 is placed so that the emission axis 17 is parallel to the sample surface.

In the configuration represented FIGS. 1 and 2 the laser beam emission axis 17 is more particularly parallel to the central branch of the Z-shape electro-magnetic micro-chip.

In the configuration represented FIG. 3 the laser beam emission axis 17 is more particularly perpendicular to the central branch of the Z-shape electro-magnetic micro-chip.

A focusing microlens 24, can be used in order to adjust the diode focus position. The microlens 24 is preferably attached to the same substrate 14, or to the laser diode 20.

The microchip can include a reflecting layer deposited on the surface. The layer (or multilayer) surface treatment can be used to trap "hot" atoms into the BEC. Such a surface treatment is chosen to provide a high reflection coefficient at the "hot" atoms wavelength, and to be transparent at the optic/laser source wavelength.

When applying a magnetic field generated by the microchip and an optical beam from the laser diode, atoms are trapped at the intersection of the BEC and of the elongated optical waveguide. An RF-outcoupler at the boundary of the BEC and the waveguide enables to couple atoms from the BEC along the optical waveguide, thus producing a coherent guided atom source. The atoms are attracted by the lowest optical potential point in the optical beam, that is at the waist of the laser beam. By adjusting the distance between the BEC and the waist of the laser beam, one can adjust the atoms velocity.

The atoms propagate along the optical waveguide, in a coherent way, along distances ranging between 0.1 and 10 mm.

The de Broglie wavelength is comprised between 0.4 μm and 5 μm.

As illustrated in FIGS. 1, 2 and 3, the device optical and magnetic functions are integrated in a single substrate, making the structure insensitive to vibrations or misalignments. The whole micro-chip can thus be integrated into a small vacuum cavity.

Figure 4:
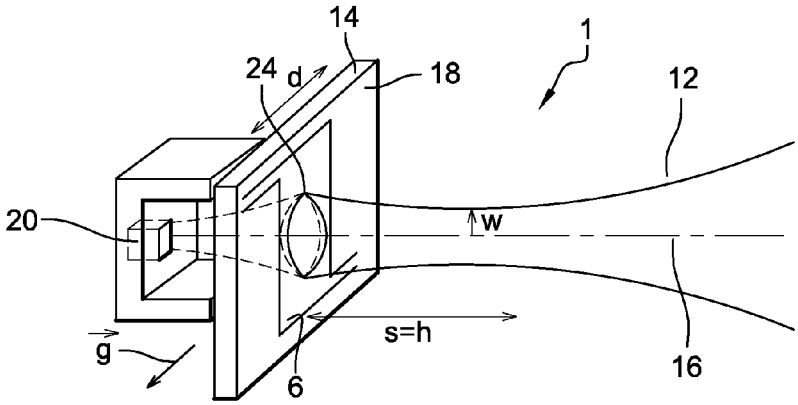
FIG. 4 represents in perspective view a third embodiment of a guided coherent atom source according to the invention using a Vertical Cavity Surface Emitting Laser (VCSEL)

FIG. 4 illustrates another embodiment of an atom source according to the invention, wherein the solid-state laser source is attached to the substrate bearing the electro-magnetic micro-chip, with its emission axis perpendicular to the substrate surface.

As in FIG. 1, electrically conductive wires 6 are formed on the surface 18 of a substrate 14. The electro-magnetic circuit comprises a double Z-shaped pattern, with the two main wires at a distance S from each other. An electric current is applied to each wire, of the same intensity. Each electric current induces a magnetic field. When combined with an homogeneous magnetic field $B_{ext}$, perpendicular to the substrate surface, a magnetic trap is produced in the plane of symmetry between the two wires. In this configuration, the magnetic trap is not located above one of the wires (contrary to configuration shown in FIGS. 1-3).

The BEC area is located in the central area between the two long branches of the two Z, at a distance h from the wires plane.

When choosing $B_{ext}=\mu_0 I/\pi S$, the magnetic trap is at a distance h=S/2 from the substrate surface. The formula to calculate confinement are the same as in the single wire configuration.

The following parameters can be used:

$$B_{ext}=6G;B_z=1G;S=2\text{ mm},I=3A;h=1\text{ mm},\ \omega=2\pi*54\text{ Hz}.$$

By adjusting the electric current applied to the electric wires 6, the BEC position and confinement can be adjusted. The BEC position can even be located inside the substrate or in front of the substrate surface opposed to the patterned wire structure.

Since confinement is less strong with the two-wires configuration, it is advisable to make the condensate using only one wire (applying current only to one of the Z-shaped wires), and then to switch to a two-wires configuration (by applying electric current to the two wires) for coupling with the optical waveguide.

A laser source 22 emission axis 17 is directed toward the BEC area of the magnetic trap, in order to create a hybrid magneto-optic trap and a waveguide for the atoms. The laser source is in this example fixed onto the substrate 14, using conventional mechanical mountings. The substrate 14 may be formed in a transparent material such as glass or sapphire. A converging microlens can be etched into the substrate. The microlens can be made from multilayers that create a focusing effect.

The optical beam goes through the microlens.

Typical parameters are a working distance of a few hundred microns, for a millimeter size lens diameter. The transverse guide frequency can typically be around a few hundred Hertz.

Figure 5A:
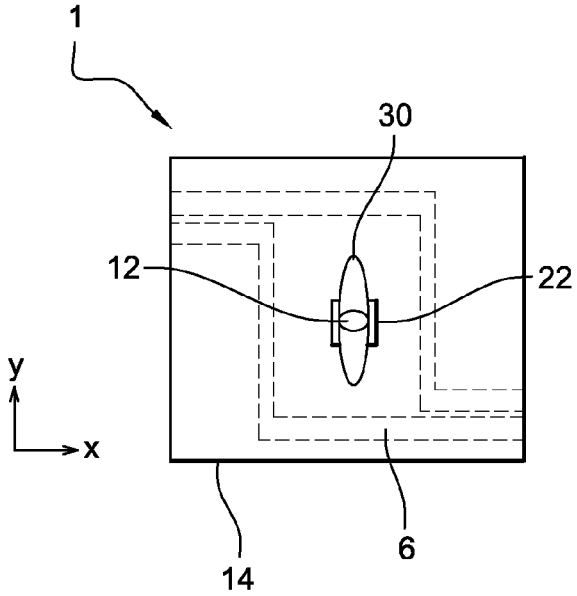
FIG. 5A represents in top view and FIG. 5B in side view the same embodiment of atom laser represented in FIG. 4.
Figure 5B:
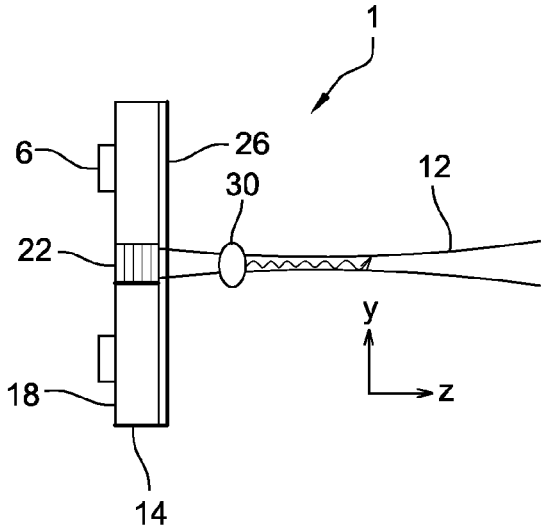

FIG. 5 shows another preferred embodiment wherein the substrate 14 includes a Vertical Cavity Surface Emitting Laser (VCSEL). The VCSEL can be provided with an integrated focusing microlens 24.

The electro-magnetic micro-chip is patterned directly on the back-emitting surface of the VCSEL substrate. The micro-chip double Z wires are patterned around the laser source so that the laser beam and the magnetic trapping area have an intersection.

In the embodiment illustrated FIG. 5, the electro-magnetic micro-chip has a double Z shape, and the two Z are located around the VCSEL emitting area. The hybrid magneto-optic trap is by construction centered on the VCSEL emission axis 16.

The embodiment illustrated on FIG. 5 provides a very small footprint, typically a few $cm^3$. The resulting atom laser source is very compact. The atom-chip surface does not hinder coupling with other light sources for atom interferometry applications.

By adjusting the electric voltage applied to the electro-magnetic micro-chip and to the laser diode power and/or waist position, it is possible to adjust the atom laser repetition rate, and the atom laser velocity.

The invention thus provides a coherent guided atom source, the atoms being extracted from a magnetic trap, wherein the atoms direction and position are very well defined in space due to the optical waveguide. The device also enables to control precisely the atoms velocity, i.e. the de Broglie wavelength of the atom laser.

The velocity can be set to any arbitrary value between 0 and 10 $mm \cdot s^{-2}$ which allows to reduce significantly the setup overall dimensions, while maintaining a very high sensitivity. These features are very important for inertial sensor applications, for example atom rate gyros.

The compact atom laser enables to realize precise atomic interferometers. Indeed, large magnetic fields from bulk ferromagnetic structures are difficult to control due to the high gradients in the vicinity of the magnetic trap and they induce systematic bias errors disturbing precision measurements. The guided coherent atom source according to the invention enables to use the cold atoms away from the atom chip, where magnetic fields/gradients are low, and to use atoms in an internal state where they are not sensitive to magnetic field.

The guided atom laser made using an atom chip enables to manufacture small size inertial sensors using ultra-cold atom source.

Figure 6:
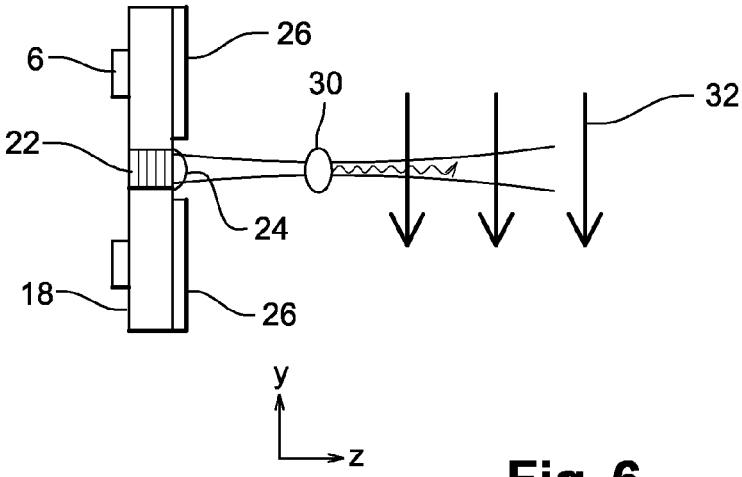
FIG. 6 represents an atomic interferometer according to the invention.

An atomic interferometer according to the invention is shown in FIG. 6.

The atoms emitted from the magneto-optic trap are coupled into the optical waveguide. The laser beam is then turned off, and the atoms are probed during their free fall due to gravity. The atoms are probed using a guided laser and series of Raman pulses (wherein internal atom states are manipulated together with external states), or Bragg pulses (wherein only external states are manipulated). The pulses can be either horizontal or vertical. The transparent area corresponds to a single beam for manipulating atomic states. The arrows correspond to the areas where the atoms are probed. The single illuminating area can be replaced with three separate light areas.

The probing time to maintain a vertical probing area (with atoms launched horizontally) is limited to around 10 ms.

For longer probing times, the atoms must be launched vertically.

Figure 7:
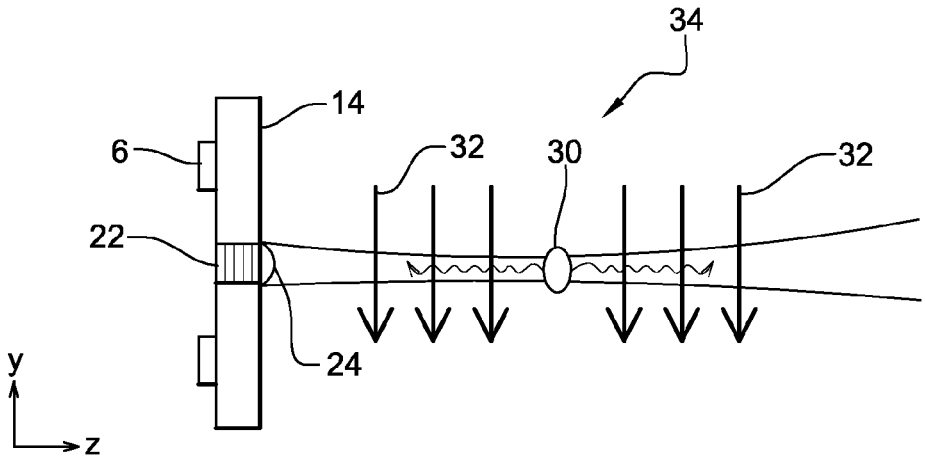
FIG. 7 represents a multiple atomic interferometer configuration according to the invention.

FIG. 7 shows another atomic interferometer configuration, with multiple interferometer. Atoms are coupled into the optical waveguide, and propagate along the two opposed directions.

An interferometer is placed on each side of the BEC, and probes atoms going in opposed directions.

This configuration allows common mode rejection, and acceleration/rotation decoupling.

The atom source according to the invention can be combined with other atom chip.

Figure 8:
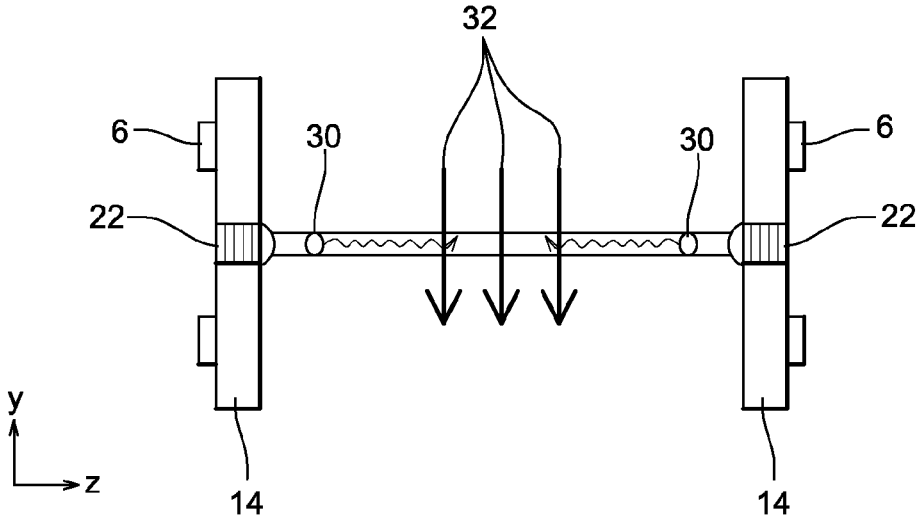
FIG. 8 represents an atomic interferometer with multiple atom laser source.

FIG. 8 shows another atomic interferometer configuration, with multiple atom laser sources. Two atom lasers are placed facing each other. The optical waveguides of the two atom lasers are aligned. Atoms from both sources are coupled into the optical waveguide and propagate in opposed directions.

An interferometer is placed between the two atom sources and probes atoms going in opposed directions. This configuration allows improved common mode rejection (due to the use of the same laser beam), and acceleration/rotation decoupling In the case where an interferometer uses Raman or Bragg pulses, interferences do not occur when the atoms are confined along two dimensions, that is along the optical waveguide 12.

The optical waveguide is then turned off to let the atoms propagate in free fall. When atoms are launched vertically, a small atom chip is necessary, so that the atoms do not fall on the substrate surface.

Figure 9A:
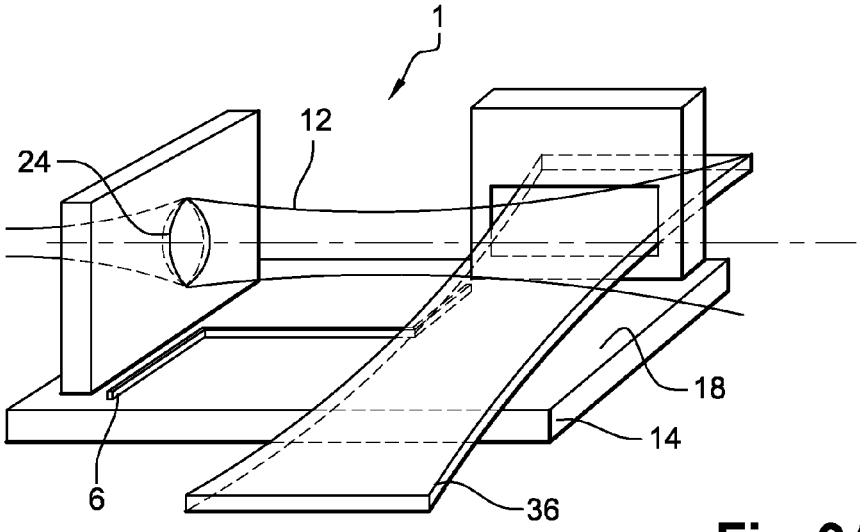
FIGS. 9A and 9B represent an atomic source according to the invention, coupled to a planar optical waveguide for improved interferometer configuration, for example to be used in an atom gyroscope.
Figure 9B:
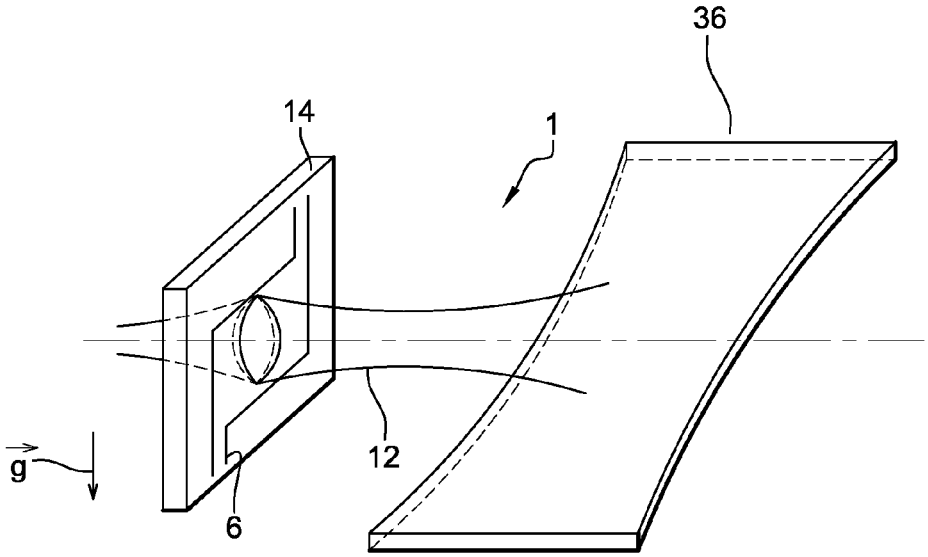

In an improved setup, shown in FIG. 9, the guided atoms are transferred from the 1D optical waveguide (12), to a 2D or planar optical waveguide (36), wherein the pulses are directed. This setup enables to increase the probing time.

The coherent guided atom source according to the invention enables to use efficiently coherent atom source.

The source of the invention provides increased brightness compared to conventional atom sources, which permits higher contrast and better measurements.

The improved optical coupling reduces the optical and electrical power required.

Atoms with lower velocity (higher de Broglie wavelength) permit compact setup.

The guided atoms provide higher performances, and avoid systematic effects due to magnetic traps.

The invention claimed is:

1. Guided Coherent Atom Source (1) comprising:

an alkaline, alkaline earth or rare earth atom source for generating neutral alkaline, alkaline earth or rare earth atoms in a gaseous state (2);

means for cooling the atoms gas (3);

means for generating a magnetic field (4), comprising an electro-magnetic micro-chip (6) deposited on a surface (18) of a substrate (14), for condensing the atoms in a magnetic trap;

means for generating an electro-magnetic RF field comprising at least one of i) electrical wires, ii) an external antenna, and iii) an integrated antenna for extracting the condensed atoms trapped in the magnetic trap; and optical means (10) comprising a diode laser (20) for emitting and directing an optical coherent beam (12) toward the condensed atoms able to guide the condensed atoms, wherein, the optical means (10) and the electro-magnetic micro-chip (6) are integrated onto the same substrate (14), and the substrate surface comprises an optical coating (26) able to reflect at the trapping wavelength for <<hot>> atoms and is transparent at the wavelength of the optical coherent beam (12).

2. Source according to claim 1, wherein the electro-magnetic micro-chip (6) and the optical means (10) are located one relatively to the other to ensure built-in intersection of the magnetic trap and of the optical waveguide.

3. Source according to claim 2, wherein the axis (16) of the optical coherent beam (12) is centered onto the magnetic trap for condensed atoms.

4. Source according to claim 2, wherein the emission axis (17) of the optical coherent beam (12) is transverse with respect to the substrate (14) surface (18) bearing the electro-magnetic micro-chip (6).

5. Source according to claim 2, wherein the emission axis (17) of the optical coherent beam (12) is parallel to the substrate (14) surface (18) bearing the electro-magnetic micro-chip (6).

6. Source according to claim 1, wherein the emission axis (17) of the optical coherent beam (12) is transverse with respect to the substrate (14) surface (18) bearing the electro-magnetic micro-chip (6).

7. Source according to claim 1, wherein the emission axis (17) of the optical coherent beam (12) is parallel to the substrate (14) surface (18) bearing the electro-magnetic micro-chip (6).

8. Source according to claim 1, wherein the optical means (10) comprise a Vertical Cavity Surface Emitting Laser (or VCSEL) (22).

9. Source according to claim 8, characterized in that the optical means (10) include a microlens (24) for directing the optical coherent beam (12).

10. Source according to claim 1, wherein the optical means (10) include a microlens (24) for directing the optical coherent beam (12).

11. Source according to claim 1, wherein the atoms are $^{87}$Rb atoms.

12. Source according to claim 1, wherein the means for generating a magnetic field (4) comprise means for generating a permanent magnetic field.

13. Source according to claim 12, wherein the means for generating a permanent magnetic field comprise a magnet layer (28) integrated into the substrate (14).

14. Source according to claim 13, wherein the electro-magnetic micro-chip (6) and the optical means (10) are located one relatively to the other to ensure built-in intersection of the magnetic trap and of the optical waveguide.

15. Source according to claim 13, wherein the axis (16) of the optical coherent beam (12) is centered onto the magnetic trap for condensed atoms.

16. Source according to claim 13, wherein the emission axis (17) of the optical coherent beam (12) is transverse with respect to the substrate (14) surface (18) bearing the electro-magnetic micro-chip (6).

17. Source according to claim 13, wherein the emission axis (17) of the optical coherent beam (12) is parallel to the substrate (14) surface (18) bearing the electro-magnetic micro-chip (6).

18. Source according to claim 13, wherein the optical means (10) comprise a Vertical Cavity Surface Emitting Laser (or VCSEL) (22).

19. Source according to claim 13, wherein the optical means (10) include a microlens (24) for directing the optical coherent beam (12).

20. Source according to claim 13, wherein the atoms are $^{87}$Rb atoms.

21. Source according to claim 13, wherein the electro-magnetic micro-chip comprises electrically conductive wires in a shape chosen from Z-shape, U-shape, double Z-shape, and/or concentric circles.

22. Source according to claim 21, wherein the electro-magnetic micro-chip comprises multilayer electrically conductive wires.

23. Atomic Interferometer comprising at least one source according to claim 13 and means for generating optical beams capable of creating Bragg or Raman-type wavepacket manipulation of the atoms from the said guided coherent atom source.

24. Source according to claim 1, wherein the electro-magnetic micro-chip comprises electrically conductive wires in a shape chosen from Z-shape, U-shape, double Z-shape, and/or concentric circles.

25. Source according to claim 14, wherein the electro-magnetic micro-chip comprises multilayer electrically conductive wires.

26. Atomic Interferometer comprising at least one source according to claim 1 and means for generating optical beams capable of creating Bragg or Raman-type wavepacket manipulation of the atoms from the said guided coherent atom source.

27. Guided Coherent Atom Source (1), comprising:

an alkaline, alkaline earth or rare earth atom source for generating neutral alkaline, alkaline earth or rare earth atoms in a gaseous state (2);

means for cooling the atoms gas (3); means for generating a magnetic field (4), comprising an electro-magnetic micro-chip (6) deposited on a surface (18) of a substrate (14), and configured for condensing the atoms in a magnetic trap;

means for generating an electro-magnetic RF field comprising at least one of i) electrical wires, ii) an external antenna, and iii) an integrated antenna arranged for extracting the condensed atoms trapped in the magnetic trap; and optical means (10) comprising a diode laser (20) for emitting and directing an optical coherent beam (12) toward the condensed atoms able to guide the condensed atoms, wherein, the optical means (10) and the electro-magnetic micro-chip (6) are integrated onto the same substrate (14), and the means for generating a magnetic field (4) comprise means for generating a permanent magnetic field, said means for generating a permanent magnetic field comprising a magnet layer (28) integrated into the substrate (14), the substrate surface comprises an optical coating (26) able to reflect at the trapping wavelength for <<hot>> atoms and is transparent at the wavelength of the optical coherent beam (12).

* * * * *